US012478149B2

(12) United States Patent
Homme

(10) Patent No.: US 12,478,149 B2
(45) Date of Patent: Nov. 25, 2025

(54) ATRAUMATIC EARRING

(71) Applicant: Gretchen Homme, Anoka, MN (US)

(72) Inventor: Gretchen Homme, Anoka, MN (US)

( * ) Notice: Subject to any disclaimer, the term of this patent is extended or adjusted under 35 U.S.C. 154(b) by 137 days.

(21) Appl. No.: 17/300,318

(22) Filed: Nov. 10, 2021

(65) Prior Publication Data

US 2023/0144272 A1 May 11, 2023

(51) Int. Cl.
*A44C 7/00* (2006.01)
*A44C 15/00* (2006.01)

(52) U.S. Cl.
CPC ..... *A44C 7/004* (2013.01); *A44C 15/0005* (2013.01)

(58) Field of Classification Search
CPC ... A44C 15/00; A44C 15/001; A44C 15/0005; A44C 15/0045; A44C 7/00; A44C 7/002; A44C 7/004; A44C 7/007; A44C 7/005
See application file for complete search history.

(56) References Cited

U.S. PATENT DOCUMENTS 1,528,882 A * 3/1925 Kennerly ..... A41F 15/02 2/337
2,377,688 A * 6/1945 Hubbell ..... A44C 7/006 24/561
4,974,430 A * 12/1990 Turner ..... A44C 7/00 24/304
5,081,853 A * 1/1992 Salyer ..... A44C 7/00 63/12
5,148,689 A * 9/1992 Azrielant ..... A44C 15/00 63/3.1
5,258,210 A * 11/1993 Chalfin ..... A44C 17/04 63/26
5,279,132 A * 1/1994 Swaim ..... A44C 15/0005 63/3.1
5,444,994 A * 8/1995 Poorting ..... A44C 15/0005 63/14.3
5,524,457 A * 6/1996 Dunham ..... A44C 7/003 63/12
6,026,515 A * 2/2000 Nielson ..... A45F 5/021 63/3
6,079,224 A * 6/2000 Schehr ..... A44C 15/0005 63/12
6,422,036 B1 * 7/2002 Giannis ..... A44C 5/2042 63/3
7,093,332 B1 * 8/2006 Kay ..... A44C 5/2057 63/3.1
D551,585 S * 9/2007 Wooley ..... D11/11
8,621,887 B1 * 1/2014 Arlow ..... A44C 7/002 63/12
10,376,023 B1 * 8/2019 Homme ..... A44C 7/00
(Continued)

*Primary Examiner* — Emily M Morgan
(74) *Attorney, Agent, or Firm* — FAEGRE DRINKER BIDDLE & REATH

(57) ABSTRACT

An earring mounting device for wearing an earring without passing the earring through skin of the ear of a user is provided. The earring mounting device includes an earring interface member and a mount. The earring interface member is operable to releasably couple to an earring, the earring interface member comprising a closed loop, and a mount. The mount includes a mount body, an adhesive, and a coupling member operable to releasable retain the closed loop of the earring interface member. The adhesive is positioned on a back surface of the mount body and is operable to releasably adhere the mount to an ear of a user.

20 Claims, 7 Drawing Sheets

(56) References Cited

U.S. PATENT DOCUMENTS

| | | | | |
|---|---|---|---|---|
| 11,317,684 | B1 * | 5/2022 | Delano | A44C 15/0055 |
| 2012/0240623 | A1 * | 9/2012 | Morse | A44C 7/002 63/12 |
| 2016/0051015 | A1 * | 2/2016 | Powers | A44C 15/001 63/18 |
| 2021/0068507 | A1 * | 3/2021 | Patrzyk | A44C 5/185 |

* cited by examiner

ATRAUMATIC EARRING

FIELD

The present disclosure relates generally to apparatuses, systems, and methods for providing atraumatic earrings. More specifically, the disclosure relates to apparatuses, systems, and methods that allow users to wear earrings on unpierced ears, pierced ears, or damaged ears. The apparatuses, systems, and methods may also be implemented on other body parts to provided atraumatic adornment.

BACKGROUND

Traditionally, earrings or other jewelry relying on piercings through the user's skin and other tissue (e.g., cartilage) to adorn the earrings or other jewelry. For a variety of reasons, piercings may not be desirable due to health conditions, aesthetics, age, and so forth. Furthermore, in some instances, the user has damaged piercing sites due to other piercings, congenital defects, or unrelated trauma. For example, stretched earlobes as a result of consistent use of heavy earrings may make it unfeasible to wear traditional earrings.

Few alternatives to traditional piercings for jewelry adornment. One example of an alternative to traditional earrings or other jewelry that relies on piercings are clip-on jewelry. Clip-in jewelry traditionally rely on a hinged portion that is operable to form a pressure or a frictional engagement with the user's tissue to prevent movement of the jewelry. Another alternative includes screw-type earrings which also form a pressure or frictional engagement with the user's tissue. These devices also have drawbacks, including but not limited to potentially painful, especially with those that are prone to sensitive skin or tissue.

SUMMARY

The present disclosure relates to an earring mounting device that may be implemented for damaged, unpierced, or pierced ears for providing the user with the ability to wear earrings. The device enables the user to adorn the earrings in an atraumatic manner or when the user's ears are incapable of supporting the earring in the typical manner.

According to one example ("Example 1"), an earring mounting device is provided for wearing an earring without passing the earring through skin of the ear of a user. The earring mounting device includes an earring interface member operable to releasable couple to an earring, the earring interface member comprising a closed loop and a mount including a mount body, an adhesive, and a coupling member operable to releasable retain the closed loop of the earring interface member, the adhesive being positioned on a back surface of the mount body, the adhesive operable to releasably adhere the mount to an ear of a user.

According to another example ("Example 2") further to Example 1, the coupling member is a hook and loop fastener positioned on a front surface of the mount body.

According to another example ("Example 3") further to Example 2, the hook and loop fastener includes a first portion including hooks, a second portion including loops, and a third portion not including hooks or loops, the third portion positioned longitudinally between the first and the second portions.

According to another example ("Example 4") further to Example 3, the third portion of the hook and loop fastener is operable to form a fold.

According to another example ("Example 5") further to Example 3, the first and the second portions of the hook and loop fastener are rigid.

According to another example ("Example 6") further to Example 1, the coupling member is an arm extending from a front surface of the mount body, the arm being operable to receive the earring interface member.

According to another example ("Example 7") further to Example 6, the arm is angled relative to the front surface of the mount body between 0 and 180 degrees.

According to another example ("Example 8") further to Example 7, the arm is angled relative to the front surface of the mount body between 10 and 60 degrees.

According to another example ("Example 9") further to Example 6, the arm includes a neck portion extending from the mount body and a body portion extending from the neck portion, the neck portion being narrower than the body portion.

According to another example ("Example 10") further to Example 9, the arm is cut from the mount body except for where the neck portion extends from the mount body.

According to another example ("Example 11") further to Example 10, the mount body includes a notch formed on each lateral side of the neck portion of the arm, wherein the notch is operable to receive and engage the earring interface member.

According to another example ("Example 12") further to Example 9, the body portion of the arm includes a generally trapezoidal profile.

According to another example ("Example 13") further to Example 1, the mount body further defines an aperture positioned proximate the coupling member, the aperture operable to receive a post of a second earring.

According to one example ("Example 14"), an atraumatic mount for an earring is provided. The atraumatic mount includes a mount body defining a front surface and a back surface, an adhesive positioned on the back surface of the mount, the adhesive operable to releasable couple to skin of a user, and a coupling member operable to releasable retain an earring, the coupling member extending from the front surface of the mount, the coupling member moveable between an open position and a closed position, wherein in the open position the coupling member is operable to receive a portion of the earring and in the closed position is operable to retain the portion of the earring.

According to another example ("Example 15") further to Example 14, the coupling member is a hook and loop fastener positioned on a front surface of the mount body.

According to another example ("Example 16") further to Example 15, the hook and loop fastener includes a first portion including hooks, a second portion including loops, and a third portion not including hooks or loops, the third portion positioned longitudinally between the first and the second portions.

According to another example ("Example 17") further to Example 16, the third portion of the hook and loop fastener is operable to form a fold.

According to one example ("Example 18"), an earring is provided, the earring including a mount body defining a front surface and a back surface, an adhesive positioned on the back surface of the mount, the adhesive operable to releasable couple to skin of a user, and a coupling member including an arm extending from the front surface of the mount, the arm including a neck portion and a body portion, the neck portion being positioned between the body portion and the first surface of the mount body and being narrower relative to the body portion.

According to another example ("Example 19") further to Example 18, the arm is angled relative to the front surface of the mount body between 10 and 60 degrees.

According to another example ("Example 20") further to Example 19, the arm is cut from the mount body except for where the neck portion extends from the mount body.

The foregoing Examples are just that, and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Description of Various Embodiments

Figure 1:
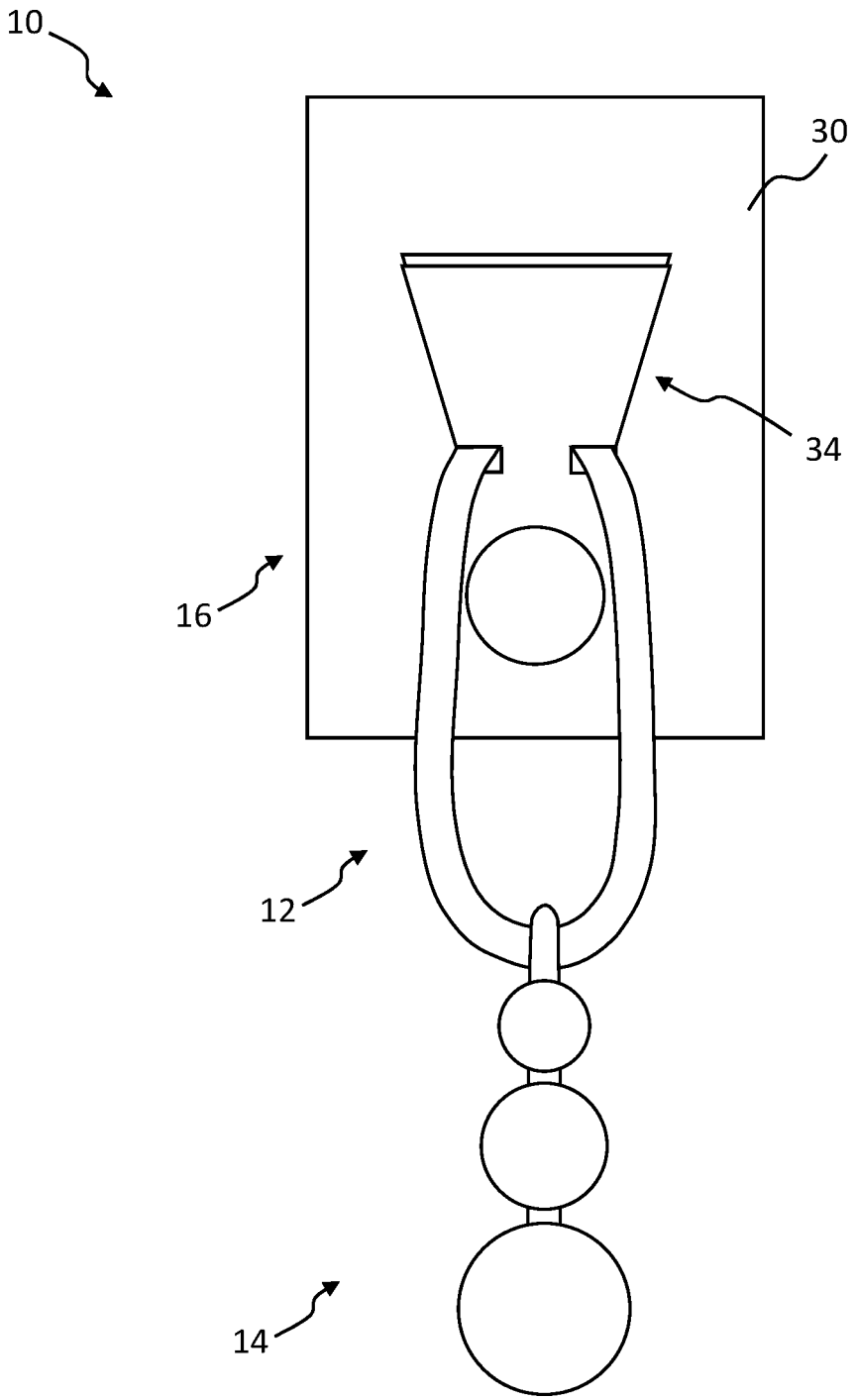
FIG. 1 is an illustration of an earring device including an atraumatic mount for an earring with an earring interface member engaged to the arm of the coupling member, the earring interface member including an earring coupled thereto, in accordance with an embodiment.

This disclosure is not meant to be read in a restrictive manner. For example, the terminology used in the application should be read broadly in the context of the meaning those in the field would attribute such terminology.

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

The device shown in FIG. 1 is provided as an example of the various features of the device and, although the combination of those illustrated features is clearly within the scope of invention, that example and its illustration is not meant to suggest the inventive concepts provided herein are limited from fewer features, additional features, or alternative features to one or more of those features shown in FIG. 1. For example, in various embodiments, one or more of the components depicted in FIG. 1 can be employed in addition to, or as an alternative to components depicted in any other of the figures and one or more of the components depicted in any of the other figures may be employed in addition to, or as an alternative to components depicted in FIG. 1.

With reference to FIG. 1, an earring mounting device 10 is illustrated. The earring mounting device 10 can be mounted to a user in order to atraumatically adorn or wear earrings 14, which can be coupled to the earring mounting device 10. Earrings may be retrofitted do be implemented with the earring mounting device 10 discussed herein, or the earrings may be specifically designed to be implemented with the earring mounting device 10. The earring mounting device 10 may be used in a variety of situations, including but not limited to use on damaged ears (e.g., split ears), gauged ears, unpierced ears, and so forth. This allows a user to wear earrings despite anatomical. The earring mounting device 100 is operable to be mounted to a backside of a wearer's ear, for example, at the earlobe to support at least one earring on the wearer's ear. The earring mounting device 10 supports one or more earrings on the wearer's ears to prevent damage (on a non-pierced ear) and to reduce further damage to a ripped or torn earlobe.

Referring to FIG. 1, an earring mounting device 10 for wearing an earring without passing the earring through skin of the ear of a user is illustrated. The earring mounting device 10 includes an earring interface member 12 operable to releasable couple to an earring 14. The earring mounting device 10 further includes a mount 16 including a mount body 30, an adhesive 32 (see FIG. 4B), and a coupling member 34 operable to releasable retain the earring interface member 12. The adhesive 32 is positioned on a back surface 36 of the mount body 30. The adhesive 32 operable to releasably adhere the mount 16 to an ear of a user. Various adhesives may be implemented for coupling the mount 16 to the ear of the user. The term "adhesive" is meant to incorporate a broad meaning to encompass any material that is capable of coupling the mount 16 to the ear of the user. For example, medical tapes, adhesives applied directly to the mount body 30, and so forth. In those embodiments implementing a medical tape, the medical tape may include an adhesive side and an opposing non-adhesive side. The medical tape is attached to the mount body 30, for example, the non-adhesive side of the medical tape using an adhesive such as an epoxy or other adhesive. Alternatively, the mount body 30 may be mechanically attached to the medical tape or the mount body 30 and medical tape may be formed as a single piece.

Figure 2:
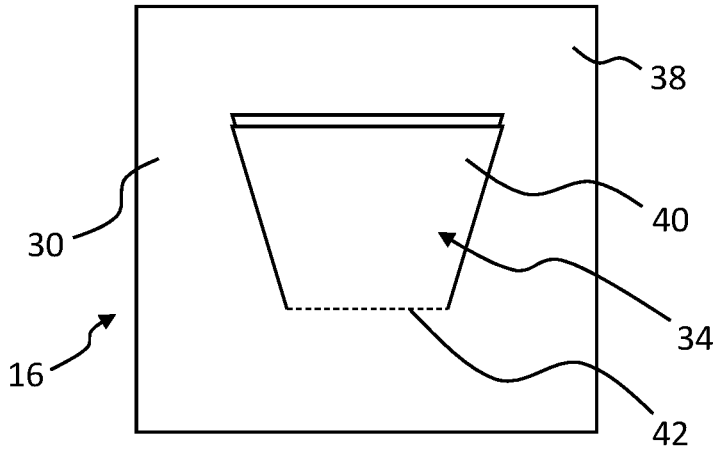
FIG. 2 is an illustration of an example of an atraumatic mount for an earring in accordance with an embodiment.
Figure 3:
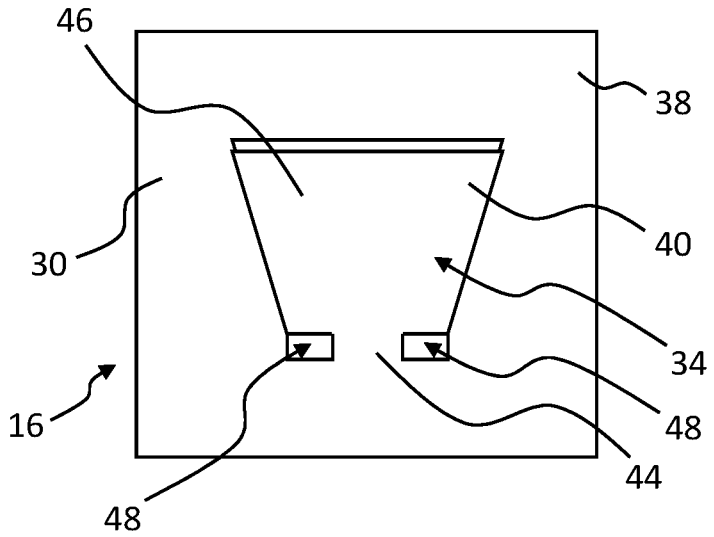
FIG. 3 is an illustration of an alternate example of an atraumatic mount for an earring, the atraumatic mount including a coupling member forming an arm and notches on each side of a portion of the arm, in accordance with an embodiment.

Referring to FIGS. 2-6, various embodiments of the coupling member 34 may be implemented. The coupling member 34 is operable to engage and retain the earring 14 (e.g., via the earring interface member 12) (see FIG. 1). Referring to FIGS. 2-4, one type of coupling member 34 is illustrated. The coupling member 34 in these embodiments includes an arm 40 extending from a front surface 38 of the mount body 30, the arm 40 being operable to receive the earring interface member 12.

Referring first to FIG. 2, a mount 16 is illustrated with a coupling member 34 including an arm 40. The arm 40 extends from the front surface 38 of the mount body 30. For example, in this embodiment, the arm 40 is cut from the mount body 30 and is bent forward along a base 42 of the arm 40 where the arm 40 was not cut from the mount body 30. The arm 40, for example, may be formed by cutting three slits through the mount body 30. The arm 40 may include various shapes, including a generally trapezoidal shape illustrated in FIG. 4 (the trapezoidal shape including the base 42 about which the arm 40 is bent forward). The arm 40 may include a wider portion at the top (e.g., in the trapezoidal shape), which enhances traction of the coupling member 34 with the earring interface member 12. Any number of configurations are understood to be within the scope of the device, including but not limited to, square, triangular, curvilinear, and so forth. It is also within the scope of this disclosure that the edges and corners of the shapes may be rounded, beveled, or chamfered in order to limit wear of articles that contact the arm 40 and mount body 30, including damage or injury that could occur by contact with the user's skin.

In some embodiments, the arm 40 is angled relative to the front surface 38 of the mount body 30 between 0 and 180 degrees. For example, when the arm 40 is cut from the mount body 30, the arm 40 may be bent away from the front surface 38 to form an angle therebetween. In some embodiments, the arm 40 is angled relative to the front surface 38 of the mount body 30 between 10 and 60 degrees. In some embodiments, the arm 40 is angled relative to the front surface at about 15 degrees, at about 20 degrees, at about 25 degrees, at about 30 degrees, at about 35 degrees, at about 40 degrees, and at about 45 degrees. The arm 40 is movable relative to the mount body 30 such that angle between the arm 40 and the front surface 38 of the mount body 30 is adjustable. This allows the user to adjust the angle to accommodate various sizes and types of earring as well as adjusting the arm to minimize contact with other body parts such as the skin positioned behind the outer ear.

Referring now to FIG. 3, in some embodiments, the earring mounting device 10 includes an arm 40 that has a neck portion 44 extending from the mount body 30 and a body portion 46 extending from the neck portion 44. In these embodiments, the neck portion 44 is narrower than the body portion 46. For example, the arm 40 may include a generally trapezoidal profile, wherein the body portion 46 includes the trapezoidal profile and the neck portion 44 extends from the short edge of the parallel edges of the trapezoid. The neck portion 44 can be bent (or pivoted in those embodiments where the arm 40 is coupled to the mount body 30 via a pivotable coupling) in order to achieve the angles discussed herein. The neck portion 44 is sufficiently wide to provide structural integrity to the arm 40. In some embodiments, the arm 40 is cut from the mount body 30 except for where the neck portion 44 extends from the mount body 30.

With further reference to FIG. 3, the earring mounting device 10 includes a notch 48 formed on each lateral side of the neck portion 44 of the arm 40, wherein the notch is 48 operable to receive and engage the earring interface member 12. The profile of each notch 48 is sufficient to receive and at least partially surround a portion of the earring interface member 12. For example, when the earring interface member 12 includes an elastic band, the profile of each notch 48 is sufficient to receive the elastic band. In some embodiments, the notches 48 may be slightly smaller than the band, thus allowing the notch to compress the elastic band to a smaller profile when inserted into the notch and to increase the holding force of the notches 48 relative to the elastic band.

The notches 48 may be formed in any number of shapes. For example, as illustrated in FIG. 3, the notch 48 may have a generally rectilinear profile. However, it is understood that other profiles such as curvilinear profiles may be implemented. Furthermore, rounding, beveled, or chamfered edges may be implemented in order to limit wear of objects against the mount body 30 at the notches 48. It is also understood that the mount body 30 may also include any number of profiles including the rectilinear profile illustrated in FIG. 3, as well as curvilinear such as ovular, circular, or a profile tuned to conform to the anatomy of the back side of the outer ear.

Figure 4A:
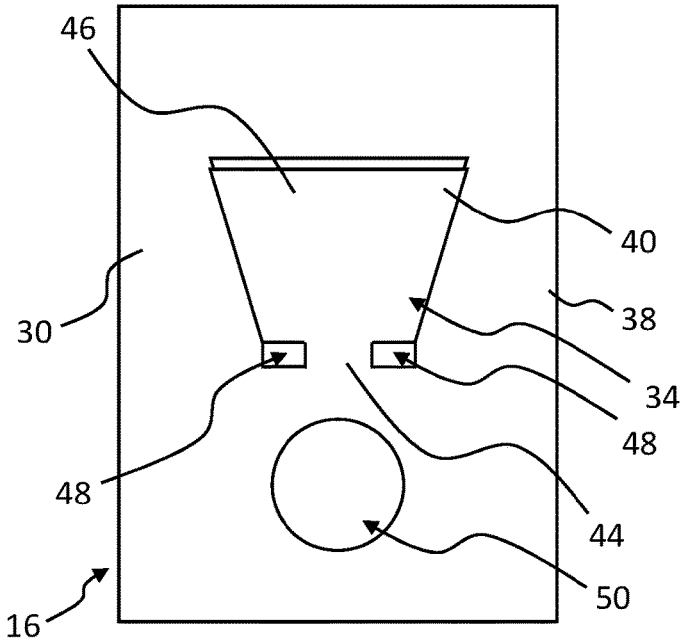
FIGS. 4A to 4C are illustrations of an alternate example of an atraumatic mount to be mounted to the skin of a user for holding an earring on a damaged ear, the atraumatic mount including a coupling member forming an arm and an aperture for a secondary earring in accordance with an embodiment.
Figure 4B:
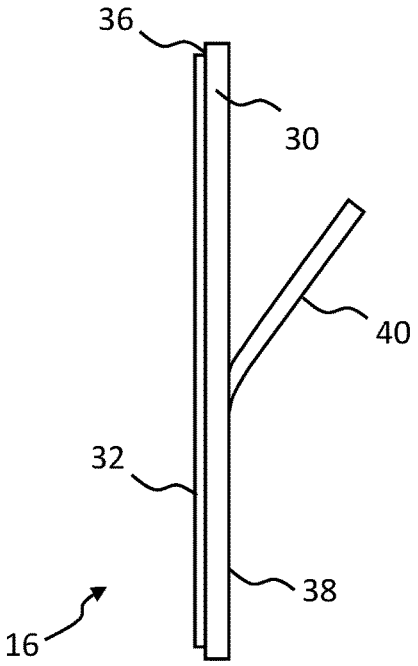
Figure 4C:
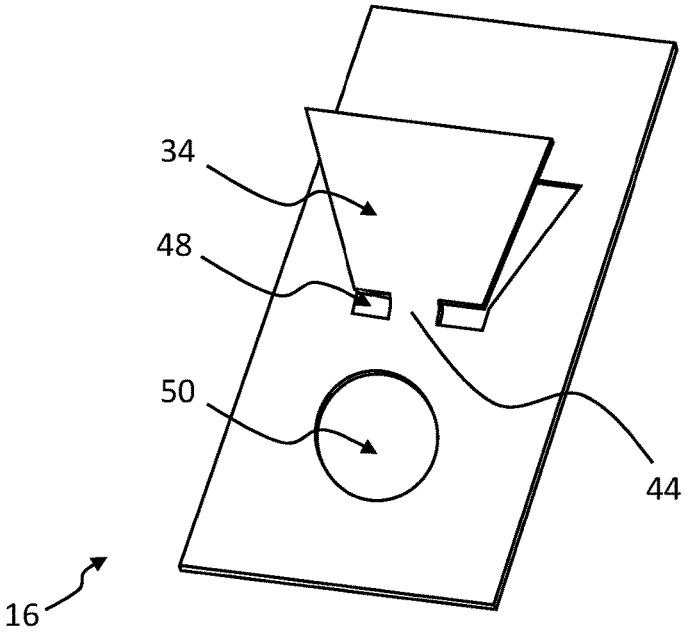
Figure 5A:
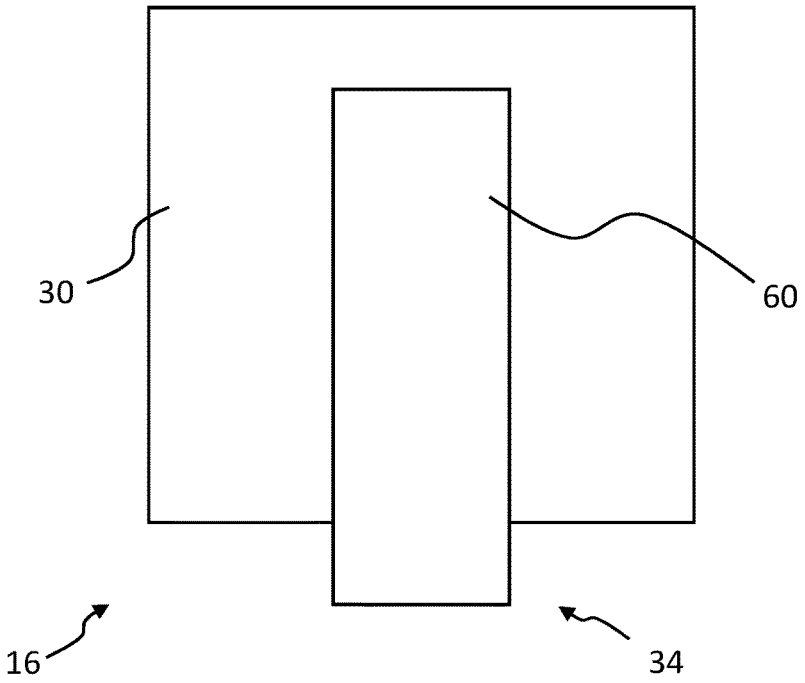
FIGS. 5A and 5B are illustrations of another alternate example of an atraumatic mount for an earring, the atraumatic mount including a hook and fastener strip, in accordance with an embodiment.
Figure 5B:
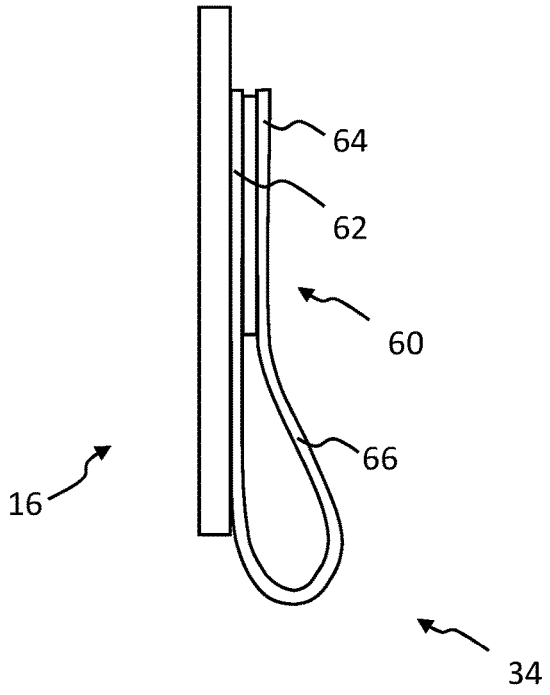

Referring now to FIGS. 4A-4C, another embodiment of a mount 16 is illustrated. In this embodiment, the mount body 30 includes an aperture 50 formed through the mount body 30. The aperture 50 is operable to receive a post 52 of a secondary earring 54 (see FIG. 8). This allows a user to wear secondary earrings 54 with posts 52 as well as the earring 14 that is mounted to the coupling member 34 as previously discussed. For example, when a user has a piercing through the ear, but the ear is not capable of supporting a heavier earring, the mount body 30 may be implemented to support a larger earring (e.g., a dangle, teardrop, chandelier, or drop earring) and a smaller, secondary earring (e.g., a stud) may be passed through the piercing and the aperture 50 in the mount body 30. The walls of the aperture 50 may further act to support the secondary earring 54 to limit damage or further damage to the ear of the user. When adhesives or other materials are implemented (e.g., adhesive 32 or hook and loop fastener 60), the secondary earring 54 may include a post that passes through the material.

FIGS. 4B and 4C provide side and perspective views of the mount 16 to illustrate the positioning of the arm 40 relative to the mount body 30. As illustrated, the neck portion 44 may include a bend or a curve that facilitates the angle between the arm 40 and the mount body 30 as previously discussed. As illustrated in FIG. 4C, when the arm 40 is angled outward from the mount body 30, an opening into the notches 48 on each side of the neck portion 44 is provided. The opening facilitates placement of the earring interface member 12 within the notch 48.

Referring now to FIGS. 5-8, an earring mounting device 10 includes a coupling member 34 that is a hook and loop fastener 60 positioned on a front surface of the mount body 30. The hook and loop fastener 60 is coupled to the mount body 30 and is operable to receive and retain the earring interface member 12.

Figure 7:
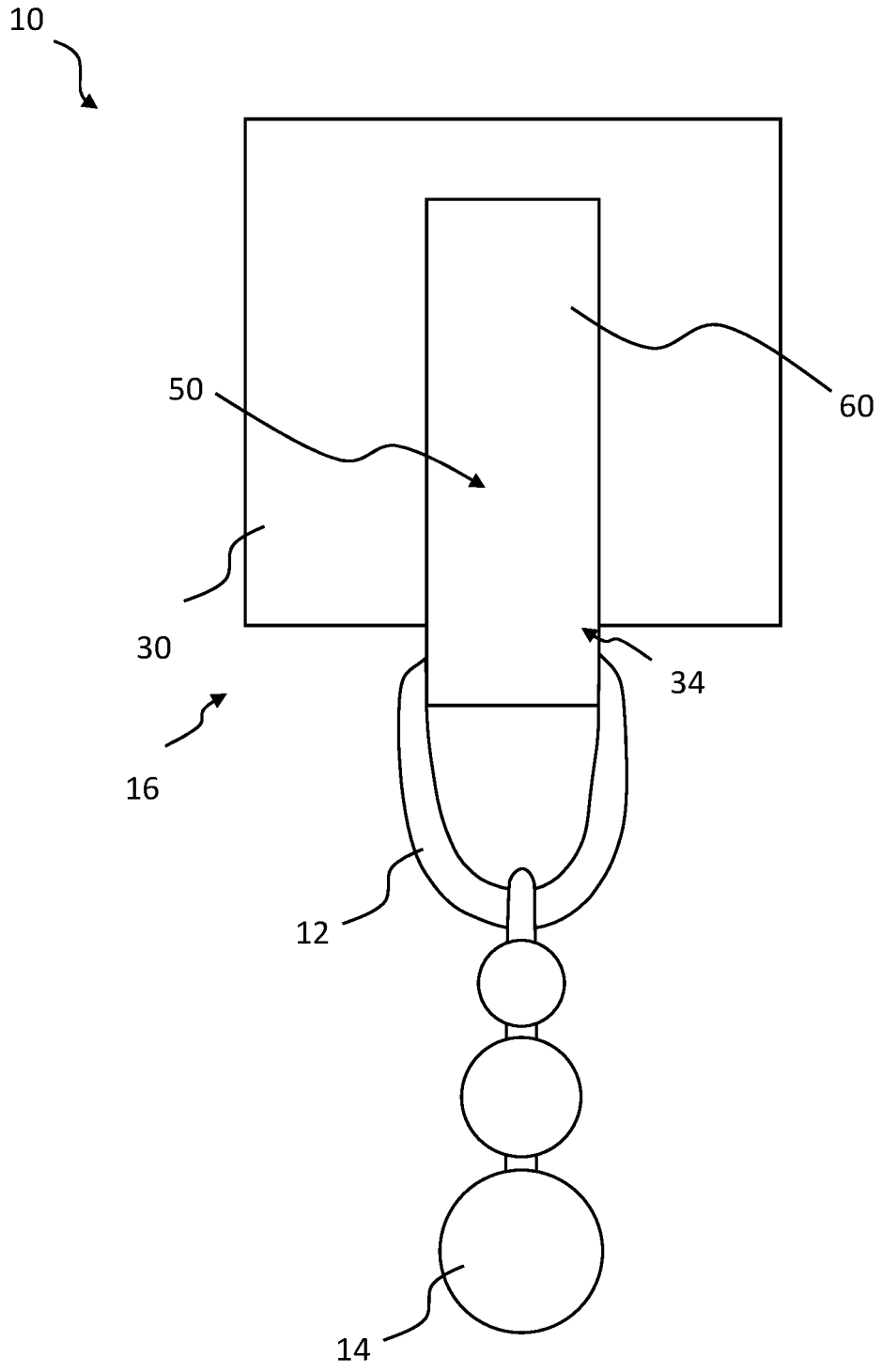
FIG. 7 is an illustration of another alternate example of an atraumatic mount for an earring, the atraumatic mount including a hook and fastener strip engaged with an earring interface member, the earring interface member including an earring coupled thereto, in accordance with an embodiment.

In some embodiments, the hook and loop fastener 60 includes a first portion 62 including hooks, a second portion 64 including loops, and a third portion 66 not including hooks or loops. The third portion 66 is positioned longitudinally between the first and the second portions 62, 64. Thus, in some embodiments, the third portion 66 is a middle portion that does not engage the with another portion of the hook and loop fastener 60 and therefore forms a loop or a hook where the earring interface member 12 is engaged. The middle portion (i.e., third portion 66) forms the bend of fold for the hook and loop fastener 60 to bend back on itself. In some embodiments, the hook and loop fastener does not include a segment free of hooks or loops. In some embodiments, the first and second portions 62, 64 of the hook and loop fastener 60 are rigid. In other embodiments, the first and second portions 62, 64 of the hook and loop fastener 60 are compliant. FIG. 7 provides an illustration of the earring mounting device 10 implemented with an earring interface member 12 and an earring 14.

Figure 6A:
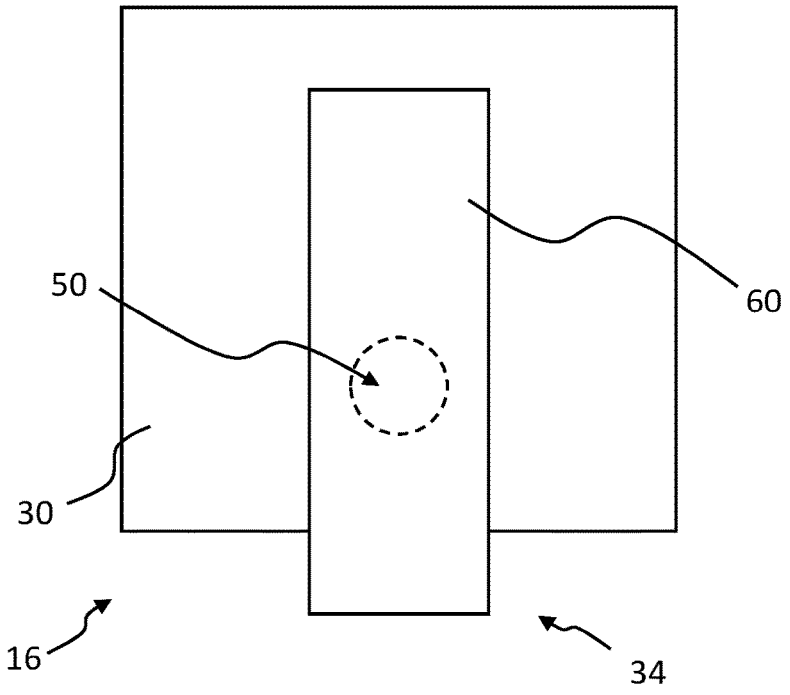
FIGS. 6A and 6B are illustrations of another alternate example of an atraumatic mount for an earring, the atraumatic mount including a hook and fastener strip and an aperture for use with a secondary earring, in accordance with an embodiment.
Figure 6B:
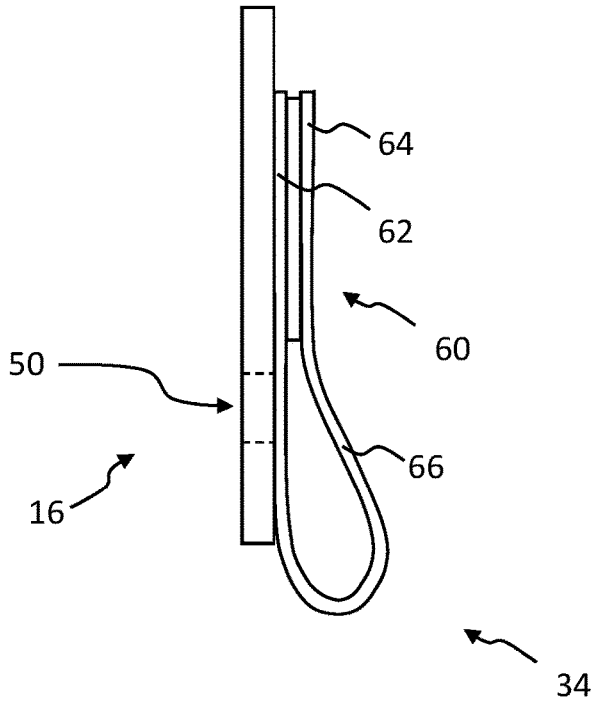
Figure 8:
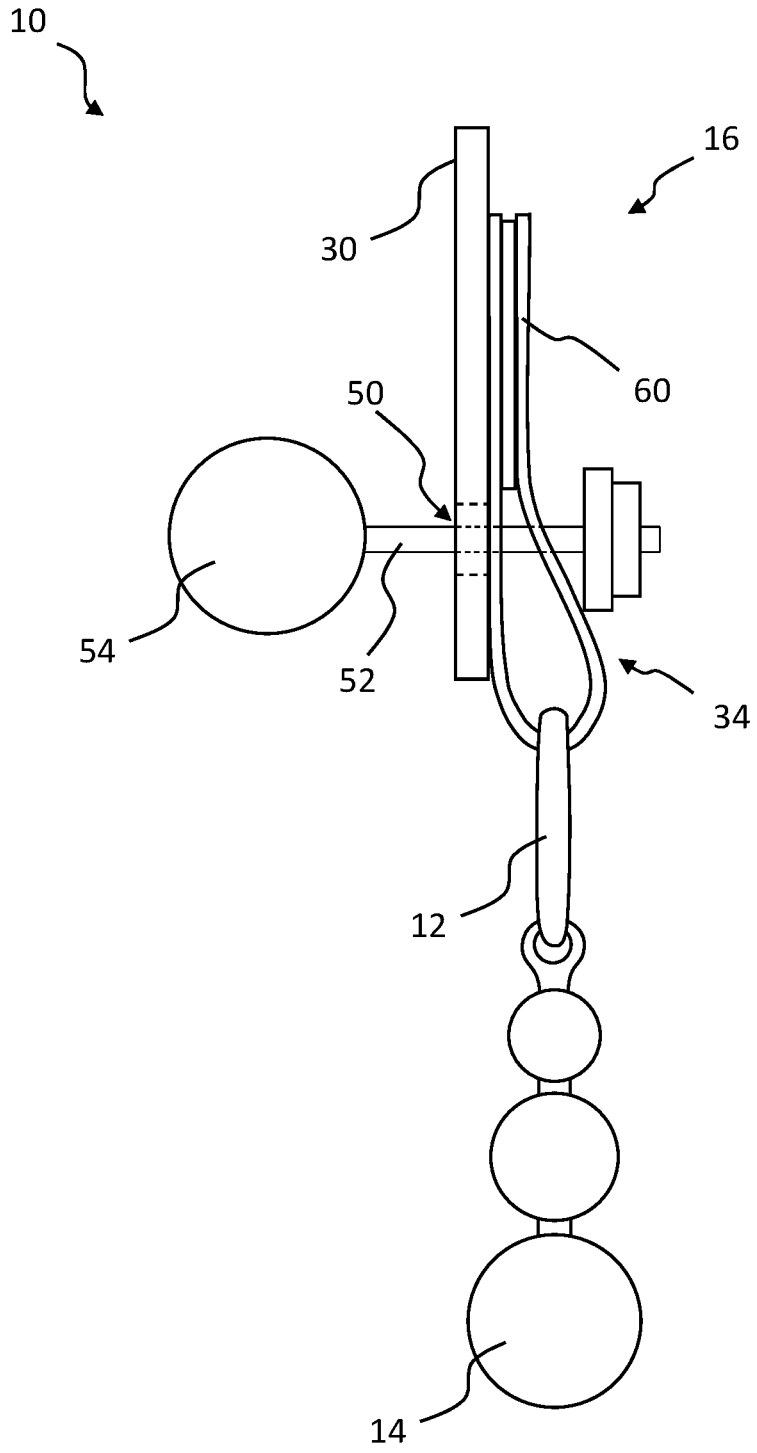
FIG. 8 is an illustration of another alternate example of an atraumatic mount for an earring including an aperture for a secondary earring, the mount being coupled to a primary earring via a hook and loop coupling member and a secondary earring via the aperture, in accordance with an embodiment.

Referring to FIGS. 6A, 6B, and 8, the hook and loop embodiment may also include an aperture 50 through which a secondary earring 54 may be inserted. The post 52 of secondary earring 54 may be inserted through the material of the hook and loop fastener 60 or the hook and loop fastener 60 may define an aperture (not shown) that aligns with the aperture 50 of the mount body 30.

In various embodiments, other fasteners may be implemented other than hook and loop fasteners. For example, the coupling member 34 may include magnetic strips (not shown) capable of forming a loop for coupling to the earring interface member 12. Any number of embodiments are considered in which the coupling member 34 is capable of forming a releasable loop for releasably retaining the earring interface member 12 (or in some embodiments, the earring 14 itself).

Referring now to the earring interface member 12, various materials and embodiments may be implemented in order to interface the earring 14 with the earring mounting device 10. For example, in some embodiments, the earring interface member 12 includes an elastic band that can be interfaced with the earring 14 and retained by the earring mounting device 10. The earring interface member 12 may include a compliant or malleable material such as a plastic or metal. The earring interface member may include a rigid material such as a high density or rigid plastic or a rigid metal. Each of these materials may be implemented to interface with an existing earring. The earring interface member 12 may be interface for example with the hook or clasp of an existing earring. In other embodiments, the earring interface member 12 may be retrofitted onto an existing earring by, for example, replacing an existing hook or clasp. For example, in some embodiments, the hook or clasp of an existing earring may be removed from the earring. The earring may include an eyelet from which the hook or clasp was removed and the earring interface member 12 may be installed onto the eyelet. In some embodiments, the earring 14 may be manufactured with an earring interface member 12. For example, the earring may be specifically designed for use with the earring mounting device 10. In other embodiments, the hook or clasp of an existing earring may be implemented as the earing interface member 12.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. An earring mounting device for wearing an earring without passing the earring through skin of the ear of a user, the earring mounting device comprising:

an earring interface member operable to releasable couple to an earring, the earring interface member comprising a closed loop; and a mount including a mount body, an adhesive, and a coupling member operable to releasable retain the closed loop of the earring interface member, the adhesive being positioned on a back surface of the mount body, the adhesive operable to releasably adhere the mount to an ear of a user, wherein the coupling member includes a trapezoidal-shaped profile, wherein the coupling member extends from the mount body such that a narrow end of the trapezoidal-shaped profile is proximate the mount body and a wide end of the trapezoidal-shaped profile is spaced from the mount body.

2. The earring mounting device of claim 1, wherein the coupling member is an arm extending from a front surface of the mount body, the arm being operable to receive the earring interface member.

3. The earring mounting device of claim 2, wherein the arm is angled relative to the front surface of the mount body between 0 and 180 degrees.

4. The earring mounting device of claim 3, wherein the arm is angled relative to the front surface of the mount body between 10 and 60 degrees.

5. The earring mounting device of claim 2, wherein the arm includes a neck portion extending from the mount body and a body portion extending from the neck portion, the neck portion being narrower than the body portion.

6. The earring mounting device of claim 5, wherein the arm is defined by material cut from the mount body except for where the neck portion extends from the mount body.

7. The earring mounting device of claim 6, wherein the mount body includes a notch formed on each lateral side of the neck portion of the arm, wherein the notch is operable to receive and engage the earring interface member.

8. The earring mounting device of claim 5, wherein the body portion of the arm includes a generally trapezoidal profile.

9. The earring mounting device of claim 1, wherein the mount body further defines an aperture positioned proximate the coupling member, the aperture operable to receive a post of a second earring.

10. An atraumatic mount for an earring comprising:

a mount body defining a front surface and a back surface;

an adhesive positioned on the back surface of the mount, the adhesive operable to releasable couple to skin of a user; and a coupling member including an arm angled away from the front surface of the mount to define a space between the arm and the mount body, the arm including a neck portion and a body portion, the neck portion being positioned between the body portion and the first surface of the mount body and being narrower relative to the body portion, wherein the neck portion, body portion, and mount body define a notch therebetween such that the notch is positioned on a lateral side of the neck portion such that the notch is defined between the mount body, a lateral edge of the neck portion, and a lower edge of body portion.

11. The atraumatic mount of claim 10, wherein the arm is angled relative to the front surface of the mount body between 10 and 60 degrees.

12. The atraumatic mount of claim 10, wherein the arm is defined by material cut from the mount body except for where the neck portion extends from the mount body.

13. The earring mounting device of claim 1, wherein the coupling member is wider at a top portion than at a bottom portion.

14. The earring mounting device of claim 1, wherein the mount body defines an aperture positioned vertically lower than the coupling member.

15. The atraumatic mount of claim 10, wherein the notch is an aperture in the mount body.

16. The atraumatic mount of claim 10, wherein the mount body defines an aperture positioned vertically lower than the coupling member.

17. An atraumatic mount for an earring comprising:

a mount body defining a first end and a second end, the mount body including a front surface and a back surface extending between the first end and the second end;

an adhesive positioned on the back surface of the mount, the adhesive operable to releasable couple to skin of a user; and a coupling member including an arm angled away from the front surface of the mount body to define a space between the arm and the mount body, the arm including a neck portion and a body portion, the neck portion being positioned between the body portion and the first surface of the mount body and being narrower relative to the body portion, wherein the mount body defines an aperture positioned vertically lower than the coupling member, wherein the neck portion and body portion define a notch therebetween such that the notch is positioned on a lateral side of the neck portion such that the notch is defined between the mount body, a lateral edge of the neck portion, and a lower edge of body portion.

18. The atraumatic mount of claim 17, wherein the coupling member is wider at a top portion than at a bottom portion.

19. The atraumatic mount of claim 17, wherein at least one notch is defined in through the mount body adjacent to the neck portion.

20. The atraumatic mount of claim 19, wherein the at least one notch includes a rectilinear profile.

* * * * *